US011994116B2

(12) United States Patent
Brevini et al.

(10) Patent No.: US 11,994,116 B2
(45) Date of Patent: May 28, 2024

(54) AXIAL PISTON PUMP WITH INCLINED PLATE

(71) Applicant: MIXTRON S.R.L., Reggio Emilia (IT)

(72) Inventors: Stefano Brevini, Reggio Emilia (IT); Renato Brevini, Reggio Emilia (IT)

(73) Assignee: MIXTRON S.R.L., Reggio Emilia (IT)

( * ) Notice: Subject to any disclaimer, the term of this patent is extended or adjusted under 35 U.S.C. 154(b) by 0 days.

(21) Appl. No.: 17/784,865

(22) PCT Filed: Dec. 2, 2020

(86) PCT No.: PCT/IB2020/061357

§ 371 (c)(1),
(2) Date: Jun. 13, 2022

(87) PCT Pub. No.: WO2021/123987

PCT Pub. Date: Jun. 24, 2021

(65) Prior Publication Data

US 2023/0003204 A1 Jan. 5, 2023

(30) Foreign Application Priority Data

Dec. 17, 2019 (IT) ..... 102019000024283

(51) Int. Cl.
*F04B 1/18* (2020.01)
*F04B 1/2042* (2020.01)

(52) U.S. Cl.
CPC ..... *F04B 1/18* (2013.01); *F04B 1/2042* (2013.01)

(58) Field of Classification Search
CPC ..... F04B 53/14–188; F04B 1/14–188
See application file for complete search history.

(56) References Cited

U.S. PATENT DOCUMENTS 2,381,056 A * 8/1945 Huber ..... F04B 1/124 417/269
2,913,911 A * 11/1959 Gilkey ..... F16H 23/04 417/269
4,342,544 A 8/1982 Pere
(Continued)

FOREIGN PATENT DOCUMENTS

DE 921246 C 12/1954
DE 19524471 A1 * 1/1997 ..... B66F 3/46
(Continued)

*Primary Examiner* — Thomas Fink
(74) *Attorney, Agent, or Firm* — Browdy and Neimark, PLLC

(57) ABSTRACT

The present invention relates to an axial piston pump (1,1') with inclined plate for pumping a liquid comprising: a head (20) in which there are at least partially a plurality of cylinders (25) in a number greater than three, with parallel central axes, a plurality of pistons (75), each one sliding inside a respective cylinder (25) of the plurality of cylinders (25) for pumping liquid, a housing seat of a suction valve (115) made in the head (20), a housing seat of a delivery valve (120) made in the head (20). The housing seat of the suction valve (115) and the housing seat of the delivery valve (120) are in direct fluid communication with each other via a rectilinear channel (155) made in the head, said channel in turn being in direct fluid communication with a cylinder (25) of the plurality of cylinders.

8 Claims, 6 Drawing Sheets

(56) References Cited

U.S. PATENT DOCUMENTS

| | | | | |
|---|---|---|---|---|
| 5,709,197 | A * | 1/1998 | Oshidari | F02M 63/0225 123/690 |
| 8,840,383 | B2 * | 9/2014 | Zhang | F04B 39/10 417/568 |
| 2011/0189041 | A1 * | 8/2011 | Zhang | F04B 1/14 417/560 |
| 2018/0058444 | A1 * | 3/2018 | Blume | F04B 53/16 |
| 2019/0145403 | A1 * | 5/2019 | Blume | F04B 1/0448 417/437 |
| 2022/0412336 | A1 * | 12/2022 | Hou | F04B 17/03 |

FOREIGN PATENT DOCUMENTS

| | | | |
|---|---|---|---|
| GB | 1320242 | A | 6/1973 |
| IT | 0780573 | A2 * | 6/1997 |

* cited by examiner

AXIAL PISTON PUMP WITH INCLINED PLATE

TECHNICAL FIELD

The present invention relates to an axial piston pump, in particular an axial piston pump with inclined plate for high pressures and usable with low viscosity fluids.

PRIOR ART

Axial piston pumps with inclined plate generally comprise a head in which there is at least partially a plurality of cylinders arranged in parallel to each other and in each of which a piston slides to pump a liquid. Said cylinders are connected to a liquid source to pump through a suction channel, usually comprising a primary duct and a plurality of branch ducts that place the primary duct in fluid communication with the cylinders.

Axial pumps with inclined plate for high pressures with three pistons are known, which on one hand are of relatively simple design and construction, particularly as regards the construction and design of the suction and delivery channels, and on the other hand have significant fluctuations in flow rate during operation.

An object of the present invention is to make available an axial piston pump with reduced delivery flow rate fluctuation which is at the same time of compact and efficient construction in fluid-dynamic terms, all within a rational and affordable solution. Such object is achieved by the features of the invention indicated in the independent claim. The dependent claims outline preferred and/or particularly advantageous aspects of the invention.

DISCLOSURE OF THE INVENTION

In particular, the invention makes available an axial piston pump for pumping liquid comprising:

- a head in which there is at least partially a plurality of cylinders in a number greater than three, with central parallel axes,
- a plurality of pistons that each slide within a respective cylinder of the plurality of cylinders for the pumping of the liquid,
- a housing seat of a suction valve made in the head, and
- a housing seat of a delivery valve made in the head, wherein the housing seat of the suction valve and the housing seat of the delivery valve are in direct fluid communication with each other via a channel made in the head, said channel in turn being in direct fluid communication with a cylinder of the plurality of cylinders and is rectilinear.

This solution makes available an axial piston pump with reduced delivery flow rate fluctuations, which is compact, robust, quick to construct and particularly efficient in fluid-dynamic terms, as it is possible, through the creation of a single channel, to connect a suction valve to a respective delivery valve and a corresponding cylinder.

According to another aspect of the invention, the channel may have a central axis which lies on a transversal plane to the central axes of the cylinders.

In such way the axial compactness of the pump is improved (axial compactness means the compactness in a direction parallel to the central axes of the cylinders)

An aspect of the invention envisages that the channel may have a uniform cross-section along the whole of its longitudinal extension.

Another aspect of the invention envisages that the channel may be part of a through hole from one side to an opposite side of the head.

In this way the head is of rapid construction, also in view of the fact that no channel depth checks are required.

According to one aspect of the invention, the pump may comprise a plurality of housing seats of respective suction valves made in the head and a plurality of housing seats of respective delivery valves made in the head and in which each housing seat of a delivery valve is in direct fluid communication with a corresponding housing seat of a suction valve via a channel of a plurality of channels made in the head, each of which is in direct fluid communication only with a single respective cylinder of the plurality of cylinders.

According to another aspect of the invention, at least one channel of the plurality of channels is placed at a different distance, from a face of the head facing a crankcase containing a rotating plate of the pump, in relation to the other channels.

With this solution, the pump is particularly compact, especially in the transversal direction to the central axes of the cylinders.

In particular, preferably, at least two channels have central axes lying on a same plane and a further channel has a central axis lying at a different distance to said face in relation to the lying plane of the central axes of the other two channels.

According to another aspect again of the invention, the channels may have longitudinal axes parallel to each other.

This characteristic contributes to improving the compactness of the pump.

Furthermore, the axial piston pump may comprise a plurality of through holes used to house tightening screws to tighten the head to a crankcase, and in which these through holes are all made in two diagonally opposite portions of the head which are subtended by two symmetrical angles having their centre in a central portion of the head and which each measure a maximum of 75°.

In this way maintenance is simplified and faster, as there is excellent access to the screws fixing the head to the crankcase.

According to another aspect of the invention, the housing seat of the suction valve has a central axis transversal to a central axis of the duct which connects it to the housing seat of the delivery valve.

In this way the valve maintenance operations are made easier and quicker, as it is simpler to access the cap closing the housing seat using standard tools.

BRIEF DESCRIPTION OF THE DRAWINGS

Further features and advantages of the invention will be more apparent after reading the following description provided by way of a non-limiting example, with the aid of the figures shown in the accompanying drawings.

BEST MODE OF THE INVENTION

Figure 1:
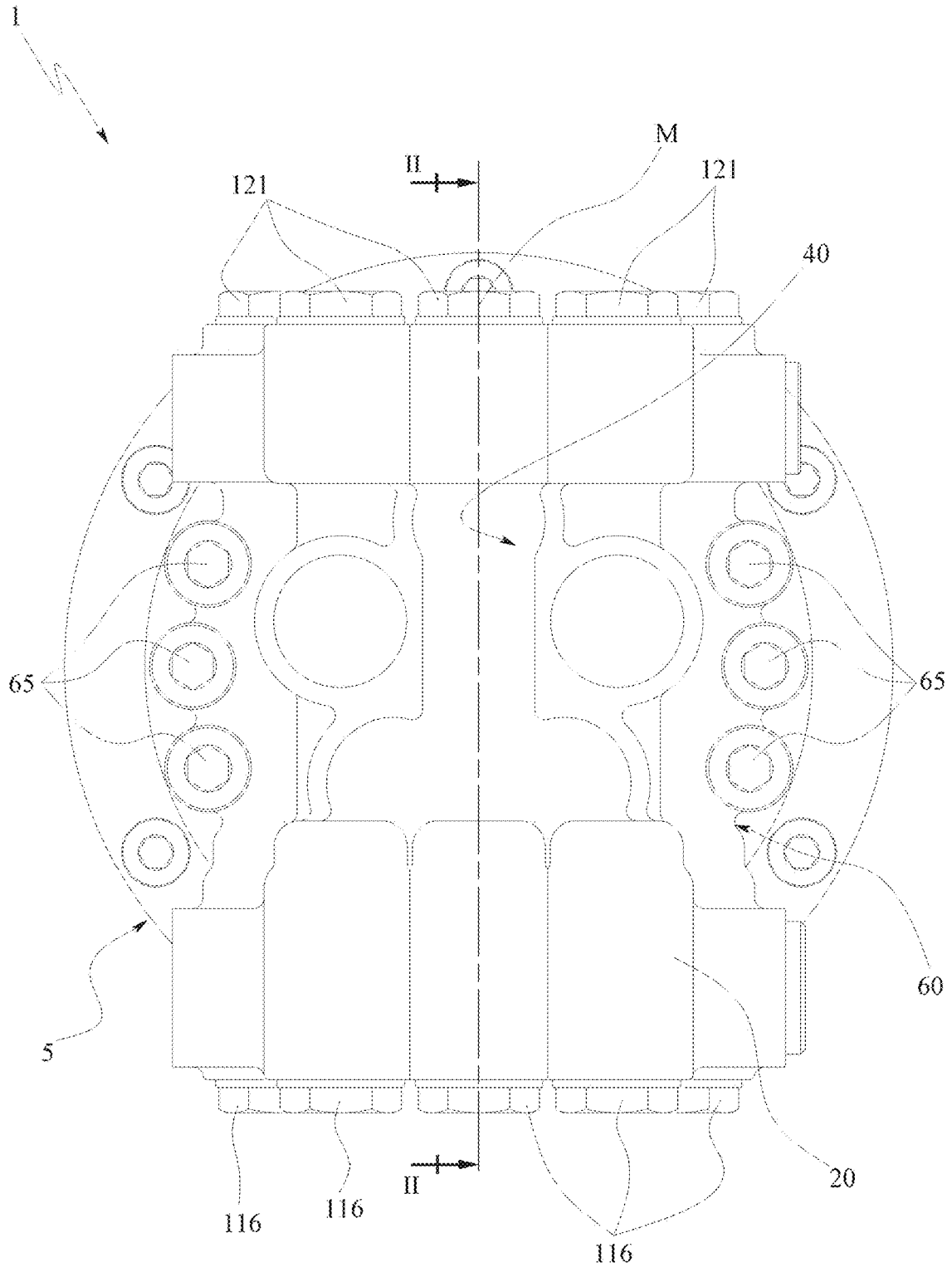
FIG. 1 is a front view of an axial piston pump according to the invention.
Figure 2:
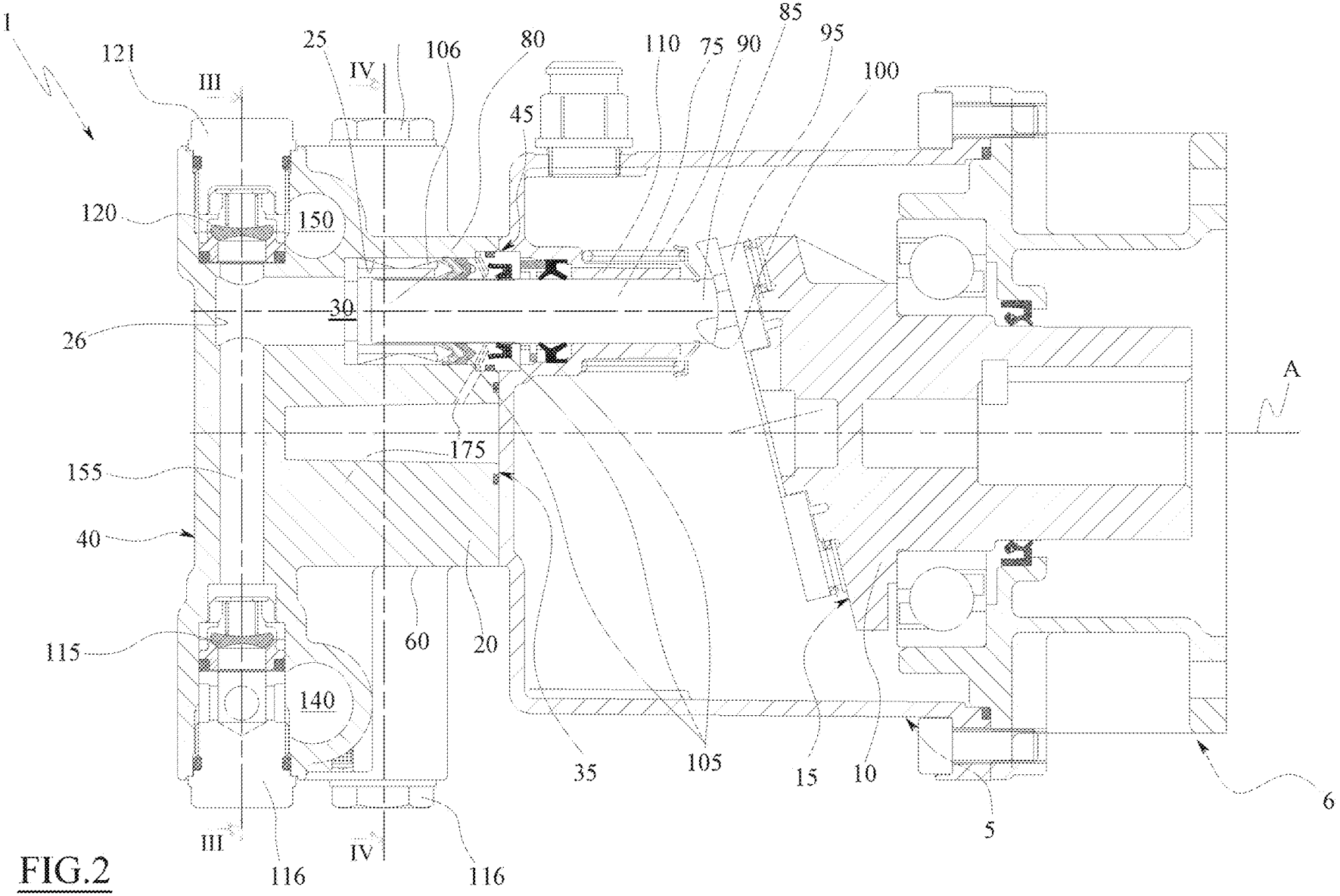
FIG. 2 is a section view of the axial piston pump in FIG. 1, taken along the plane II-II.
Figure 3:
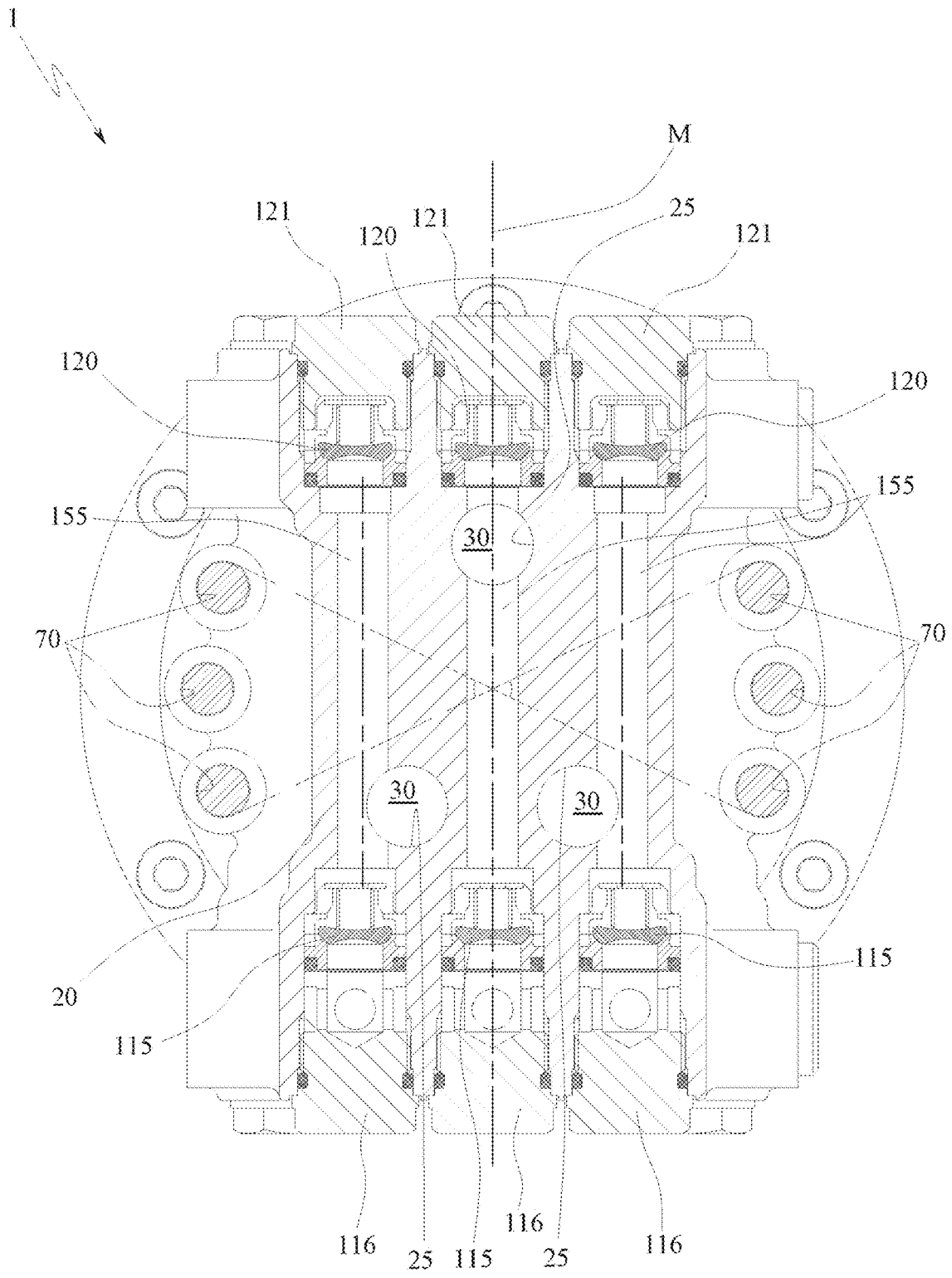
FIG. 3 is a section view according to the plane III-Ill of FIG. 2.
Figure 4:
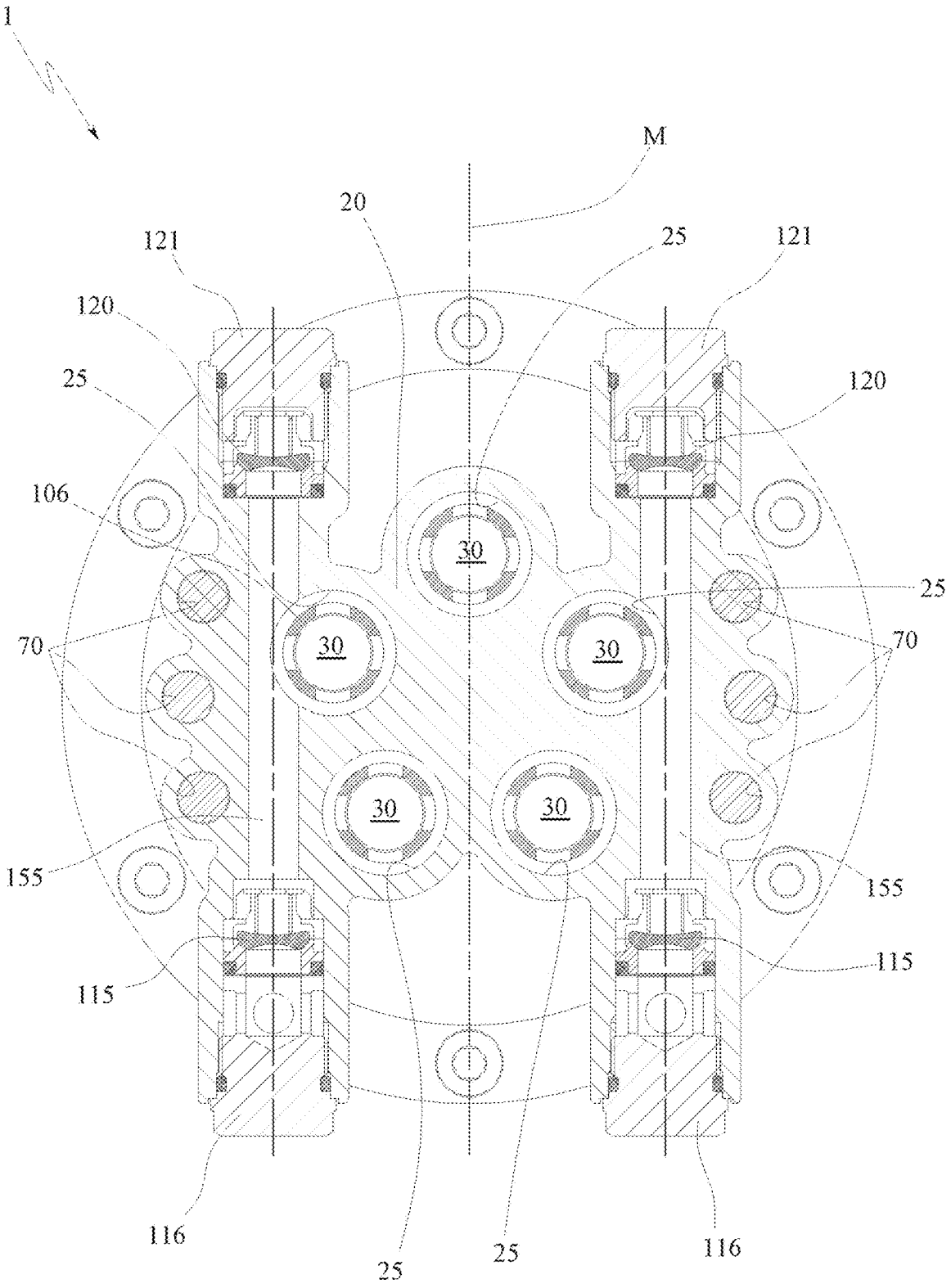
FIG. 4 is a section view according to the plane IV-IV of FIG. 2.

With particular reference to these figures, 1,1' indicates overall an axial piston pump for high pressures, preferably suited for pumping liquids with low viscosity, for example water.

For example, the axial piston pump 1,1' is of the type fitted with a fixed inclination rotating plate, as better described below. Furthermore it is of the type fitted with automatic valves for controlling the pumping flow.

The axial piston pump 1,1' may comprise a crankcase 5, a rotating inclined plate 10, adapted to receive a rotating motion from a crankshaft external to the axial piston pump 1,1', and for example a fixing flange 6 fixed to a motor equipped with said crankshaft.

The inclined plate 10 is housed in the crankcase 5, it is rotatably associated to it on a pivot axis A, and for example comprises a flat annular surface 15 lying on an inclined plane in relation to the pivot axis A. In particular, the inclined plate is rotatably associated by a bearing to the flange 6, which is bolted to the crankcase 5.

The axial piston pump 1,1' comprises a head 20 fixed to the crankcase 5, or fixed without residual degrees of freedom to the crankcase 5, in which there is a plurality of cylinders 25, that is cylindrical holes, each one adapted to contain respective liquid pumping chambers 30.

The head 20 can be made in a unitary body, that can be obtained by processing a single body obtained from the solidification of a single cast or injection of material into a mould.

The cylinders 25 of the plurality of cylinders 25 are more than three, that is at least four, preferably there are five, and are arranged with their respective central axes parallel to each other.

For example, the cylinders 25 are arranged radially along a common axis, in relation to which the axes of the single central cylinders are parallel. Furthermore they are placed at an equal distance from each other and at the same distance to the common axis. In other words, the cylinders 25, that is the central axes of the cylinders 25, are arranged at equidistant angles to each other along an imaginary circumference centred on the common axis. In the shown embodiment, the common axis of the cylinders 25 is coaxial to a central axis of the head. For example, said common axis is also coaxial to the pivot axis A.

Again in the shown embodiment, in which there are five cylinders, the central axes of the cylinders pass through the vertices of an imaginary regular pentagon lying on a perpendicular plane to the central axes of the cylinders themselves.

Preferably the cylinders 25 are made as blind holes, each one with an opening facing the base frame.

In particular, the head may comprise a first face 35, which is transversal to the central axes of the cylinders, and is proximal to, preferably in contact with, the crankcase 5, and is for example flat, and an opposite second face 40, which is transversal to the central axes of the cylinders and is distal to the crankcase 5. The cylinders 25, that is cylindrical holes, cross only the first face 40 making the respective opening in it.

The cylindrical holes can for example have a cross-section that is not constant along their axial extension. This characteristic allows the creation of shoulder surfaces.

It is specified that the second face 40 and the first face 35 are connected by a tubular shaped side surface 60 of the head.

Each cylinder comprises a bottom wall 26 lying on a transversal plane, for example perpendicular, to the axis of the cylinder itself. For example, the bottom wall 26 is separated from the second face of the head by a non-null distance.

The cylinders 25 all have the same diameter.

For further detail, the plurality of cylinders 25 comprises a first cylinder the central axis of which lies on a centreline plane M of the pump parallel to the central axes of all the cylinders, a second cylinder, a third cylinder, a fourth cylinder and a fifth cylinder, in which the second and third cylinders are specular to the fourth and fifth cylinders in relation to said centreline plane. Furthermore, the second cylinder and the fifth cylinder are closer to the first cylinder and are further from the centreline plane compared to the third and fourth cylinders.

The axial piston pump 1,1' comprises a plurality of pistons 75 each adapted to slide in a respective cylinder 25, driven by the inclined plate 10 to pump the fluid.

In particular, following the rotation of the inclined plate 10, the pistons 75 are made to slide along the central axes of the respective cylinders 25 between a top dead centre, in which the volume of the pumping chamber 30 is minimal, and a bottom dead centre, in which the volume of the pumping chamber is maximum.

In the shown embodiment, each piston 75 has a first axial end 80 which partially delimits the pumping chamber and an opposite second axial end 85 which protrudes from the cylinder inside the crankcase 5 and, via a respective elastic element 90, is held in contact with an annular guide 95 which rests on the flat annular surface 15 of the inclined plate 10, for example by interposition of an axial roller bearing.

Each elastic element 90 has a first end connected to the crankcase 5 and a second end connected to the piston 75, for example near the second end 85.

The second axial end 85 may be rounded and convex in shape. In this case the annular guide 95 has a concave annular surface 100 adapted to house the second axial end and allows relative sliding between the annular guide and the second axial end 85. In particular, the concave annular surface 100 defines a profile, in a section plane containing the pivot axis, with a radius of curvature of between 1.5 and 1.7 times the diameter of the piston 75, preferably 1.6 times.

The axial piston pump 1,1' comprises a plurality of annular gaskets 105 adapted to embrace and seal a respective piston 75, for example these annular gaskets being some housed in the crankcase 5 and others in the head 20, to prevent the fluid communication between the pumping chambers 30 and the crankcase 5.

Furthermore, the axial piston pump 1,1' may comprise a plurality of guide cylinders 110, for example made in the crankcase 5, each one adapted to guide a respective piston 75 sliding along the central axis of the corresponding cylinder 25*a*, 25*b*, 25*c*, 25*d*, 25*e*.

These guide cylinders 110 are in communication with the respective first openings 45 in the head 20. In particular, the gaskets housed in the crankcase 5 are inserted in an annular cavity between the respective cylinder 25*a*, 25*b*, 25*c*, 25*d*, 25*e* and the corresponding guide cylinder 110.

The axial piston pump 1,1' may comprise a axially hollow spacer 106 so that the piston can slide inside it, which at one axial end is in contact with the bottom wall 26 and at the opposite end is in contact with the annular gaskets 105. The spacer 106 also comprises radial openings used to allow the circulation of the suctioned and pumped liquid.

Furthermore, the pump 1,1' may comprise a suction valve 115 and a delivery valve 120 for each cylinder 25, the valves of which are automatic and single-acting and allow the definition of the flow direction from and to the pumping chamber 30. In particular the suction valve 115 allows the flow only to the pumping chamber 30 and the delivery valve 120 allows the flow only from the pumping chamber 30.

It is specified that automatic valve refers to a valve configured to open automatically allowing fluid communication, between two environments between which it is interposed, when a pre-set difference between the pressures in both environments divided by the valve itself is reached. Specifically, automatic valves do not exploit electromechanical operating mechanisms but only differences in pressure.

Each suction valve 115 comprises an inlet mouth and an outlet mouth, which is in fluid communication with the pumping chamber, and each delivery valve 120 comprises an inlet mouth, which is in fluid communication with the pumping chamber, and an outlet mouth.

The pump 1,1' comprises a respective housing seat for each suction valve 115 made directly in the head, for example made directly in the head as a hollow with an opening that flows externally to the head and is closed by a suction cap 116 configured to maintain the respective suction valve 115 in position in its housing seat.

The pump 1,1' comprises a suction channel 140 for the distribution of the liquid to be pumped to the cylinders 25. In particular, the suction channel 140 is in direct fluid communication with a portion of the housing seats of each suction valve 115 upstream of the suction valve 115 in relation to the flow direction of the fluid when the pump is in use. That is to say, the suction channel 140 is in direct fluid communication with the inlet mouth of each suction valve 115.

In the shown embodiment, the suction channel 140 is shaped as a cylindrical duct with a central axis perpendicular to a plane containing the central axis of a cylinder of the plurality of cylinders, for example perpendicular also to the centreline plane M of the pump.

The pump 1,1' comprises removable fixing means of a pipe, external to the pump, which place said pipe in direct fluid communication with the suction channel 140. For example these means may comprise a rapid coupling/decoupling collar or a threaded and axially hollow connection body.

The pump 1,1' comprises a housing seat for each delivery valve 120 made directly in the head, for example made directly in the head as a hollow with an opening that flows externally to the head and is closed by a delivery cap 121 configured to maintain the respective delivery valve 120 in position in its housing seat.

The pump 1,1' comprises a delivery channel 150 for collecting the pumped liquid, which is in direct fluid communication with the delivery valves 120, and is placed downstream to it in relation to the fluid direction when the pump is in use. For example, the delivery channel 150 is in direct fluid communication with the outlet mouth of each delivery valve 120.

In detail, the delivery channel 150 is in direct fluid communication with a portion of the housing seats of each delivery valve 120 downstream of the delivery valve 120 in relation to the flow direction of the fluid when the pump is in use.

In the shown embodiment, the delivery channel 150 is shaped as a cylindrical duct with a central axis perpendicular to a plane containing the central axis of a cylinder of the plurality of cylinders, for example perpendicular to the centreline plane M of the pump.

The pump 1,1' comprises removable fixing means of a pipe, external to the pump, which places said pipe in direct fluid communication with the delivery channel 150. For example these means may comprise a rapid coupling/decoupling collar or a threaded and axially hollow connection body.

The pump 1,1' comprises a rectilinear channel 155, made in the head, by which the housing seat of the suction valve 115, for example a portion of said seat downstream of the suction valve 115 in relation to the fluid flow direction when the pump is in use, and the housing seat of the delivery valve 120, for example a portion of said seat upstream of the delivery valve 120 in relation to the fluid flow direction when the pump is in use, are in direct fluid communication with each other.

In other words, by said channel the outlet mouth of the suction valve 115 is in direct fluid communication with the inlet mouth of the delivery valve 120.

Furthermore, via the channel 155 only one cylinder 25 of the plurality of cylinders is in direct fluid communication with said valve seats.

In particular, the channel 155 places a single housing seat of a suction valve 115 in direct fluid communication with only one housing seat of the corresponding delivery valve 120 and only with a respective cylinder 25.

The channel 155 extends directly from the housing seat of the suction valve 115 to the housing seat of the corresponding delivery valve 120 and is rectilinear along the whole extension between said housing seats, which for example substantially define the axial ends of the channel itself.

In practice, the channel 155 comprises only three communication mouths, of which a first communication mouth is at the axial end of the channel 155 in direct fluid communication with the housing seat of the suction valve 115, for example with a portion of said seat downstream of the suction valve 115 in relation to the fluid flow direction when the pump is in use, a second communication mouth is at the opposite axial end of the channel 155 in direct fluid communication with the housing seat of the delivery valve 120, for example with a portion of said housing seat upstream of the delivery valve 120 in relation to the fluid flow direction when the pump is in use, and a third mouth in direct communication with the cylinder 25.

The channel 155 has an internal surface which directly intersects the respective cylinder 25, that is it directly intersects an internal surface of the respective cylinder, forming a communication mouth between the channel 155 and the respective cylinder 25. In practice the third mouth is defined by the intersection between the internal surface of the channel 155 and the internal surface of the cylinder 25.

Preferably, the channel 155, that is its internal surface, has a uniform cross-section along its whole extension. For example, the channel 155, that is its internal surface, is shaped as a rectilinear cylindrical channel with a constant cross section along its extension.

Furthermore, the channel 155, that is its internal surface, has a central axis which lies on a transversal plane, for example perpendicular in the embodiment of the pump 1 shown in FIGS. 1-4, to the central axes of the cylinders 25. In the embodiment of the pump 1' shown in FIGS. 5-6, the central axis of the channel is inclined in relation to the central axis of the cylinder to form an acute angle, for example between 1° and 4°.

Preferably, in all embodiments, the pump 1,1' comprises a plurality of channels 155, one for each cylinder 25, according to at least one of the characteristics described above. In particular, each channel 155 places a housing seat of a suction valve 115 of the plurality of suction valves in direct fluid communication with only the corresponding cylinder 25 of the plurality of cylinders and with only the corresponding housing seat of the respective delivery valve 120 of the plurality of delivery valves.

Each channel 155 is separate and independent from the other channels 155. That is, the internal surface of each channel does not intersect the internal surface of any other channel 155 and the pump has no secondary channel used to place in direct fluid communication portions of two or more channels 155.

The channels 155 are preferably arranged all with central axes parallel to each other and perpendicular to the central axes of the cylinders.

At least one channel 155, that is the respective central axis, of the plurality of channels 155 is arranged at a different distance greater than a distance from the first face 35 compared to the other channels, for example so that the distance greater than a distance of said central axis from the lying plane perpendicular to the central axes of the cylinders of any one of the other channels is greater than the thickness of the channel itself measured along the direction of the central axes of the cylinders.

In particular, in the shown embodiments of the pump 1,1', there is a channel 155 for each cylinder, of which three channels 155 have central axes which lie on a same plane perpendicular to the central axes of the cylinders and the other two channels have central axes lying on the same plane parallel to the lying plane of the central axes of the other three channels 155 and separated by a non-null distance therefrom. Preferably the lying plane of the two channels is closer to the first face than the lying plane of the three channels, for example so that the distance of the lying plane of the two channels from the lying plane of the other three channels is greater than the thickness of the channel itself measured along the direction of the central axes of the cylinders.

For example, the plurality of channels 155 comprises a first channel 155 made in the head so that its central axis lies on a centreline plane M and intersects, directly and perpendicularly, the central axis of the first cylinder. The first channel crosses a portion of the head between, on one side, the second and the third cylinder, and on the other side the fourth and fifth cylinder, so that between the first channel and said second, third, fourth and fifth cylinders there is always a wall of non-null thickness. The plurality of channels 155 comprises a second channel and a third channel, coplanar to the first channel and which respectively intersect the second cylinder and the fifth cylinder so that the central axes of said channels are skewed in relation to the central axes of said cylinders. The plurality of channels 155 also comprises a fourth channel and a fifth channel, which are coplanar to each other, specular to each other in relation to the centreline plane M which crosses a first cylinder, are more external than said centreline plane M compared to the other three channels, and are closer to the first face 35 than the three channels, for example in an amount greater than the thickness of the channel itself measured along the direction of the central axes of the cylinders. Furthermore, the fourth and fifth channels are offset in relation to the other channels, in relation to a direction parallel to the central axes of the cylinders.

In the embodiment shown in FIGS. 1-4, each channel 155 is defined by a through hole which extends from a portion of the side surface 60 of the head 20, crossing the respective housing seats of the delivery valve and of the suction valve. In particular, in this embodiment the hollow of the housing seat of the suction valve 115 and the hollow of the housing seat of the delivery valve 120 have central axes which are parallel to each other, for example, coaxial to each other, and the openings of said hollows are made in diagonally opposite positions of the side surface 60.

Figure 5:
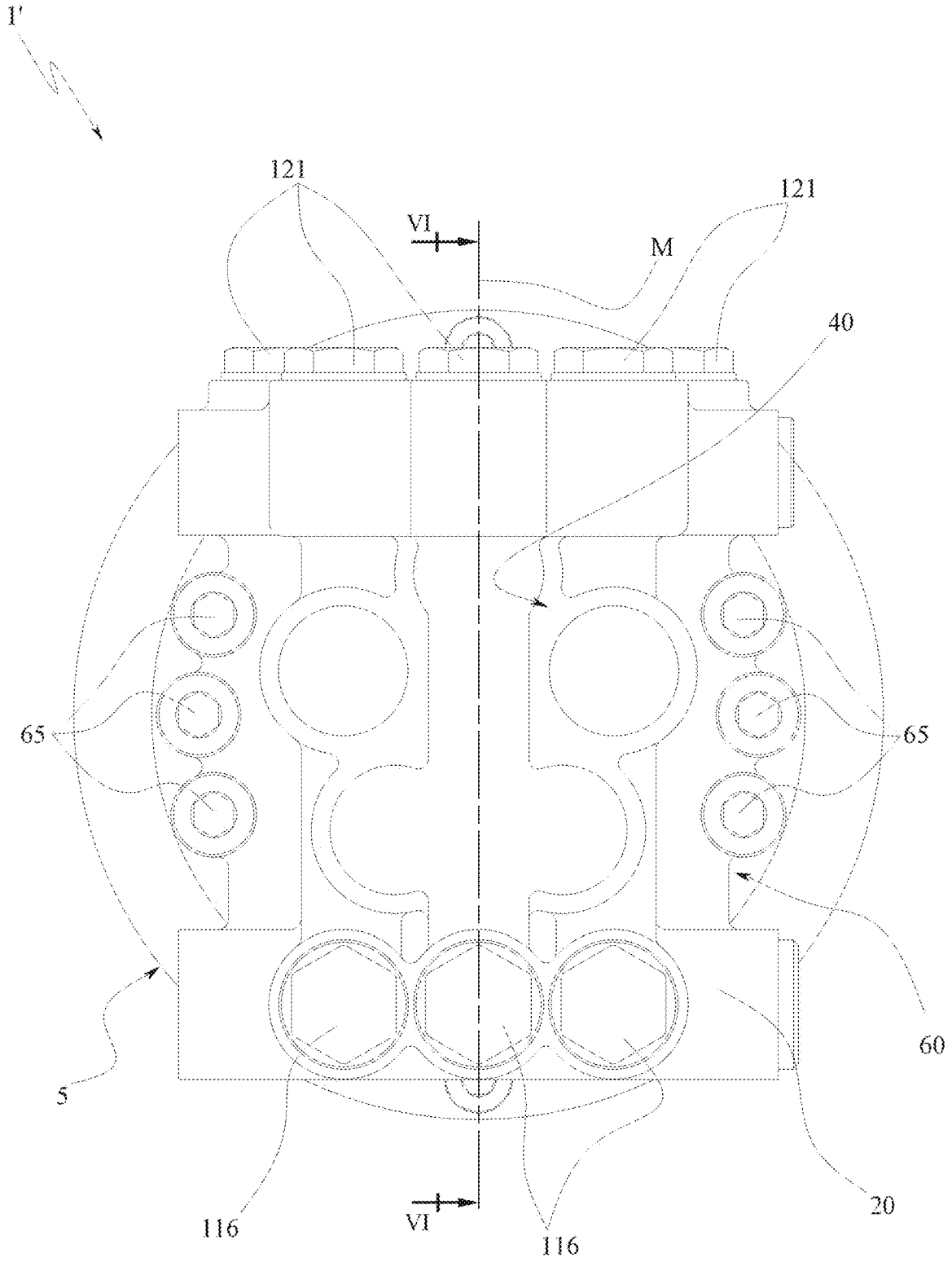
FIG. 5 is a front view of another embodiment according to the invention of the axial piston pump.
Figure 6:
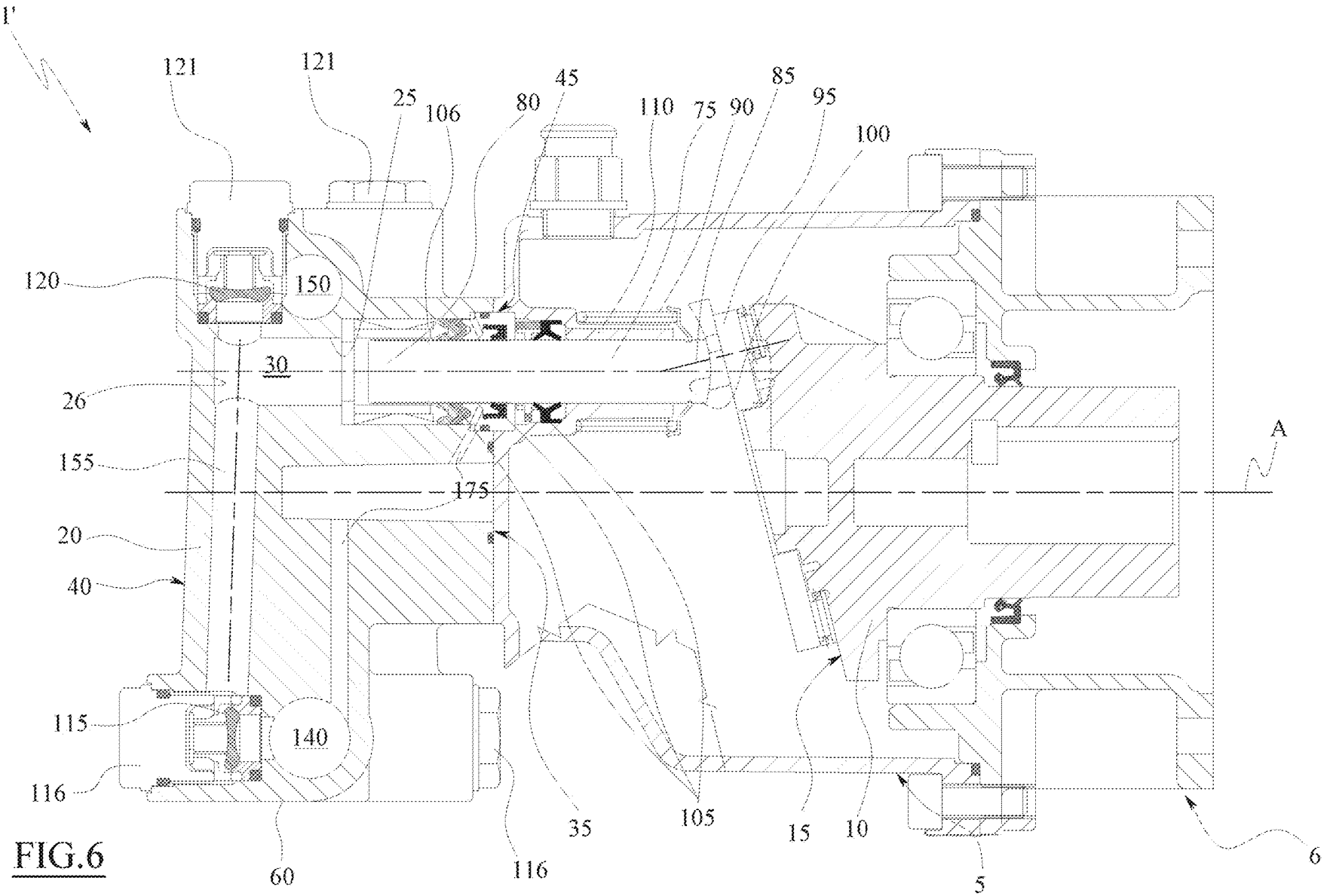
FIG. 6 is a section view according to the plane VI-VI of FIG. 5.

In the embodiment shown in FIGS. 5-6, the hollow of the housing seat of each suction valve 115 is arranged with a transversal central axis, for example perpendicular to the central axis of the respective channel and parallel to the central axes of the cylinders. In particular, a part of the housing seats faces the direction of the crankcase 5 and a part faces the opposite direction.

In both embodiments of the housing seats, the suction channel 140 is placed entirely at a distance from the first face between at least a channel at a shorter distance from the first face and the other channels. In particular, the suction channel 140 is made in a portion of the head between a group formed by the first, the second and the third channel and a group formed by the fourth and fifth channels.

The delivery channel 150 is also placed entirely at a distance from the first face between at least a channel at a shorter distance from the first face and the other channels. In particular, the delivery channel is made in a portion of the head between a group formed by the first, the second and the third channel and a group formed by the fourth and fifth channels.

The openings in the delivery channels are all facing one direction, for example they may lie on a same plane.

In both embodiments, the axial piston pump 1,1' may comprise a plurality of tightening screws 65, for example in a number at least equal to the number of cylinders 25, preferably in a greater number than the number of cylinders, configured to fix the head 20 to the crankcase 5 and which are inserted in as many through holes 70 made in the head 20.

The through holes 70 are divided into only two groups of holes, the two groups being placed each one on diagonally opposite sides of the pump in relation to the common axis of the cylinders and in a position radially further from said common axis compared to all channels 155.

For example the two groups of holes 70 are made in diagonally opposite portions of the head which are subtended by two symmetrical angles having their centre in a central portion of the head, that is with their centre in the common axis of the cylinders and lying on a plane perpendicular to said common axis, and which each measure a maximum of 75°.

Preferably a group of holes 70 is symmetrical to the other group in relation to the centreline plane M of the pump.

Again in both embodiments, the pump 1 may also comprise return ducts 175 which place the cylinders 25 in direct fluid communication with the suction channel 140. In particular, each return duct 175 flows into a portion of the respective cylinder axially positioned between a pair of annular seal gaskets 105. This axial portion is placed near the crankcase 5.

In this way it is possible to directly take the liquid under pressure leaking from the annular gaskets present in the cylinder directly to the suction channel.

The operation of the invention is the following.

After the movement of the inclined rotating plate, in one or more cylinders at the same time, the movement of the respective piston towards a bottom dead centre generates a vacuum inside the pumping chamber, which in turn causes the respective delivery valve to close and the respective suction valve to open. Consequently, liquid is suctioned by the suction channel 140, from there directly enters the respective housing seat of the suction valve to then reach the corresponding pumping chamber 30 crossing the respective suction valve 115 and subsequently the channel 155. Having reached the bottom dead centre, the piston rises towards the top dead centre following the thrust of the inclined plate, generating an overpressure in the pumping chamber which closes the suction valve and opens the delivery valve. The fluid therefore flows through the channel 155 towards the delivery valve 120, through which it is collected in the housing seats of the delivery valve and subsequently in the delivery channels.

The invention thus conceived is susceptible to several modifications and variations, all falling within the scope of the inventive concept.

Moreover, all the details can be replaced by other technically equivalent elements.

In practice, the materials used, as well as the contingent shapes and sizes, can be whatever according to the requirements without for this reason departing from the scope of protection of the following claims.

The invention claimed is:

1. An axial piston pump with an inclined plate for pumping liquid comprising:

a head in which there is at least partially a plurality of cylinders in a number greater than three, with central parallel axes, a plurality of pistons that each slide within a respective cylinder of the plurality of cylinders for the pumping of the liquid, a housing seat of a suction valve made in the head, a housing seat of a delivery valve made in the head, wherein the housing seat of the suction valve and the housing seat of the delivery valve are in direct fluid communication with each other via a rectilinear channel made in the head, said channel in turn being in direct fluid communication with a cylinder of the plurality of cylinders, wherein the axial piston pump comprises a plurality of housing seats of respective suction valves made in the head and a plurality of housing seats of respective delivery valves made in the head and in which each housing seat of a delivery valve is in direct fluid communication with a corresponding housing seat of a suction valve via a channel of a plurality of channels made in the head, each of said channels being in direct fluid communication only with a single respective cylinder of the plurality of cylinders and wherein a channel of the plurality of channels is placed at a different distance, from a face of the head facing a crankcase containing an inclined plate of the pump, in relation to the other channels.

2. The axial piston pump according to claim 1, wherein each channel has a central axis which lies on a transversal plane to the central axes of the cylinders.

3. The axial piston pump according to claim 1, wherein each channel has a uniform cross-section along the whole of its longitudinal extension.

4. The axial piston pump according to claim 1, in which the channels have central axes that are parallel to each other.

5. The axial piston pump according to claim 1, comprising a plurality of through holes used to house tightening screws to tighten the head to a crankcase, and in which these through holes are all made in two diagonally opposite portions of the head which are subtended by two symmetrical angles having their centre in a central portion of the head and which each measure a maximum of 75°.

6. The axial piston pump according to claim 1, in which each channel is part of a through hole which crosses the head from one side to the opposite side.

7. The axial piston pump according to claim 1, in which the housing seat of the suction valve has a central transversal axis transverse to a central axis of the channel connecting the housing seat of the suction valve to the housing seat of the delivery valve.

8. An axial piston pump with an inclined plate for pumping liquid comprising:

a head in which there is at least partially a plurality of cylinders in a number greater than three, with central parallel axes, a plurality of pistons that each slide within a respective cylinder of the plurality of cylinders for the pumping of the liquid, a housing seat of a suction valve made in the head, a housing seat of a delivery valve made in the head, wherein the housing seat of the suction valve and the housing seat of the delivery valve are in direct fluid communication with each other via a rectilinear channel made in the head, said channel in turn being in direct fluid communication with a cylinder of the plurality of cylinders, wherein the channel is part of a through hole which crosses the head from one side to the opposite side.

* * * * *